US006605021B2

(12) United States Patent
Kobayashi et al.

(10) Patent No.: US 6,605,021 B2
(45) Date of Patent: Aug. 12, 2003

(54) POSITIONABLE-AXLE BICYCLE ERGOMETER

(75) Inventors: Kando Kobayashi, Machida (JP); Minoru Kato, Kashiwa (JP)

(73) Assignee: President of Tokyo University, Tokyo (JP)

( * ) Notice: Subject to any disclaimer, the term of this patent is extended or adjusted under 35 U.S.C. 154(b) by 99 days.

(21) Appl. No.: 09/873,305

(22) Filed: Jun. 5, 2001

(65) Prior Publication Data

US 2002/0028732 A1 Mar. 7, 2002

(30) Foreign Application Priority Data

Sep. 7, 2000 (JP) ..... 2000-271817

(51) Int. Cl.[7] ..... A63B 21/00
(52) U.S. Cl. ..... 482/57; 482/51
(58) Field of Search ..... 482/51, 55, 56, 482/57–65, 70, 71, 148

(56) References Cited

U.S. PATENT DOCUMENTS 5,419,747 A 5/1995 Piaget et al.
5,573,481 A * 11/1996 Piercy et al. ..... 482/57

FOREIGN PATENT DOCUMENTS

JP 2685131 * 12/1997 ..... A63B/69/00

* cited by examiner

*Primary Examiner*—Nicholas D. Lucchesi
*Assistant Examiner*—Tam Nguyen
(74) *Attorney, Agent, or Firm*—Oblon, Spivak, McClelland, Maier & Neustadt, P.C.

(57) ABSTRACT

A positionable-axle bicycle ergometer comprises axles each to be supplied with a rotational force from a corresponding pedals and a corresponding arms, seats each supporting a corresponding axles, guide sections each supporting a corresponding seats such that seats can reciprocate in a direction perpendicular to axles, positioning mechanisms each for positioning a corresponding guide sections on the basis of an rotation angle of the axles and braking mechanisms each braking a corresponding axles.

3 Claims, 6 Drawing Sheets

POSITIONABLE-AXLE BICYCLE ERGOMETER

CROSS-REFERENCE TO RELATED APPLICATIONS

This application is based upon and claims the benefit of priority from the prior Japanese Patent Application No. 2000-271817, filed Sep. 7, 2000, the entire contents of which are incorporated herein by reference.

BACKGROUND OF THE INVENTION

The present invention relates to a positionable-axle bicycle ergometer suitable for training, for example, sprinters.

The results of analysis concerning the motion of elite sprinters of the world, or the result of research of sports science concerning the relationship between leg muscular strength and running ability clarify that it is necessary, to achieve a good score in a sprint, to strengthen the extension muscles (hamstrings) and the flexor muscles (quadriceps) of the thighs connected to the hip joint, so as to enable the thighs to move at high speed.

FIG. 6 is a schematic side view illustrating the motion trajectory of the hip, knee and ankle of a top sprinter, using the position of the greater trochanter of the hip joint as a fixed reference point. As shown in FIG. 6, zones AB, BC, CD, DE and EA correspond to "swing-down stage", "ground-contact stage", "early kick-up stage", "late kick-up stage", and "swing-back stage", respectively. The "ground-contact stage" is divided into "early ground-contact stage (landing stage)" in which a landing motion is executed, and "middle/late ground-contact stage (kick stage)" in which a kick motion is executed. During the running motion, "swing-down stage" AB, "ground-contact stage" BC and "early kick-up stage" CD require much muscular force, whereas "late kick-up stage" DE and "swing-back stage" EA require little muscular force.

Irrespective of the fact that the importance of the actions of the hip joint extension muscles, mainly hamstrings, is indicated, no conclusive method for strengthening them has yet been found. Not so appropriate training methods, using a rubber tube or a conventional training machine (such as a leg curl machine), are still being employed.

As indoors leg training machines for athletes, especially sprinters, treadmills (endless running plates), bicycle ergometer, step-type exercise ergometer and cross-country-ski type training machines, etc. are cited.

The treadmill is a load application machine equipped with a motion belt having its rotational speed and inclination made adjustable, on which the exerciser walks or runs. Many people run or walk on the treadmill to increase their body stamina.

The bicycle ergometer is a load application machine utilizing pedaling of a fixed-axle bicycle. This machine is used to strengthen leg muscles or to increase body stamina.

In the step-type exercise ergometer (for example, a striding-type exercise apparatus disclosed in U.S. Pat. No. 5,419,747), the exerciser, while standing, alternately steps on the left and right steps of the ergometer, as if they were walking up stairs. The feet of the exerciser repeat a vertical motion within a predetermined range along an arc.

In the cross-country-ski type training machine, the exerciser slides their legs forward and backward in a large angle in a reciprocated manner, and moves their arms as if holding ski poles. Since the legs are horizontally moved on the floor forward and backward, a muscle training effect can be obtained in a position in which the exerciser is kept in contact with the floor.

The above-described training methods using conventional training machines are disadvantageous in the following points.

In the case of the treadmill, the exerciser cannot automatically correct their style of running, and further a positive muscle training effect cannot be expected.

In the bicycle ergometer, since the radius of rotation in the pedaling exercise is constant, the range of motion of muscles is limited, compared with the running motion. Specifically, in the pedaling exercise, a main pedal driving force is used in a motion range corresponding to the swing-down stage and the landing stage (early ground-contact stage), whereas only a small muscle force is used in the kick stage (late ground-contact stage). This differs from the ideal running motion.

In the step-type exercise ergometer, the feet of the exerciser repeat a vertical motion of a predetermined range along an arc. In other words, the exerciser executes a stepping motion in one place along part of a circle about an axis of rotation. This differs from the trajectory of the legs in the motion of running or walking. Accordingly, it is difficult to totally and specifically train the muscles and nerves used for running or walking.

Using the cross-country-ski type training machine, the exerciser cannot imitate a running motion, notably, the swinging up of the leg after the ground-kicking motion, followed by the forward swinging down.

BRIEF SUMMARY OF THE INVENTION

It is the object of the invention to provide a bicycle ergometer capable of strengthening leg muscles and muscles relating to the motion of the pelvis or the hip joint, thereby enhancing the ability of walking or running.

The bicycle ergometer of the present invention enables the exerciser to walk or run with an ideal leg load and trajectory, thereby enhancing their ability of walking or running.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiment of the invention will be described with reference to the accompanying drawings.

[Embodiment of the Invention]

Figure 1B:
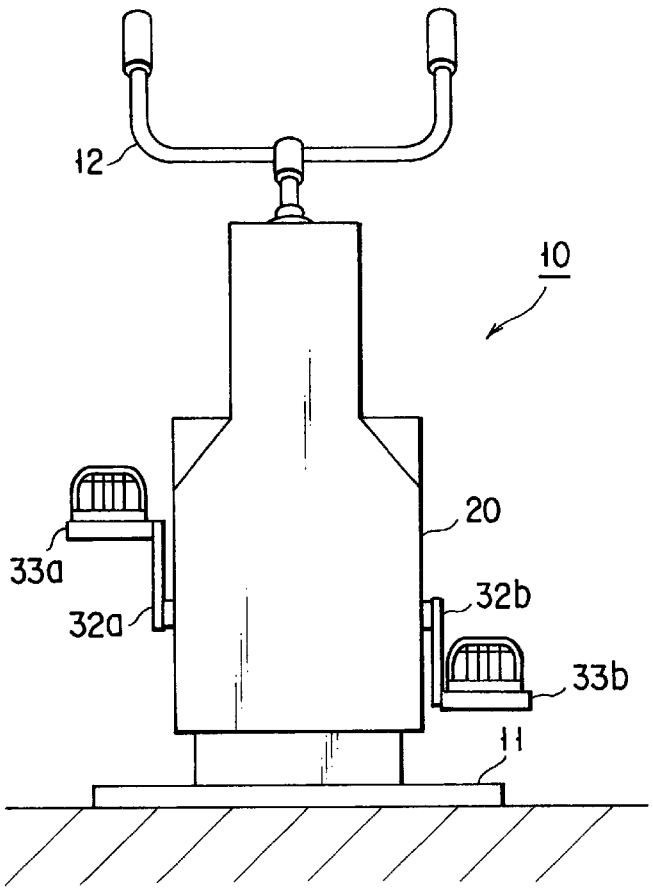
FIG. 1B is a front view of the bicycle ergometer of FIG. 1A.
Figure 1A:
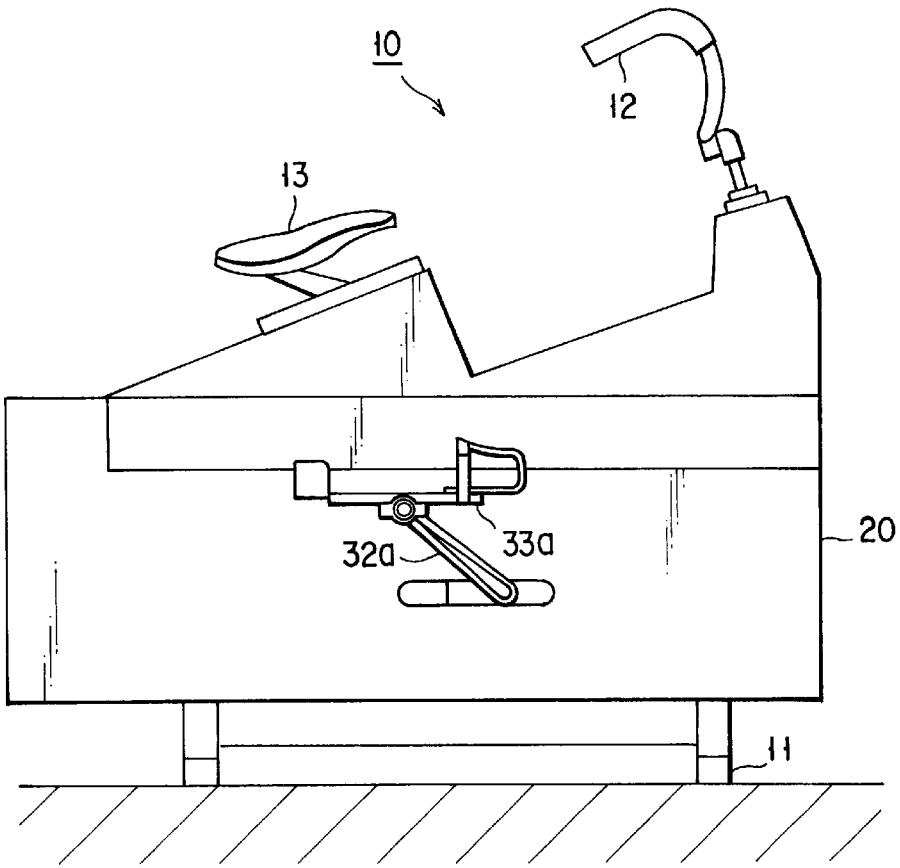
FIG. 1A is a side view illustrating a positionable-axle bicycle ergometer according to the embodiment of the invention.
Figure 2:
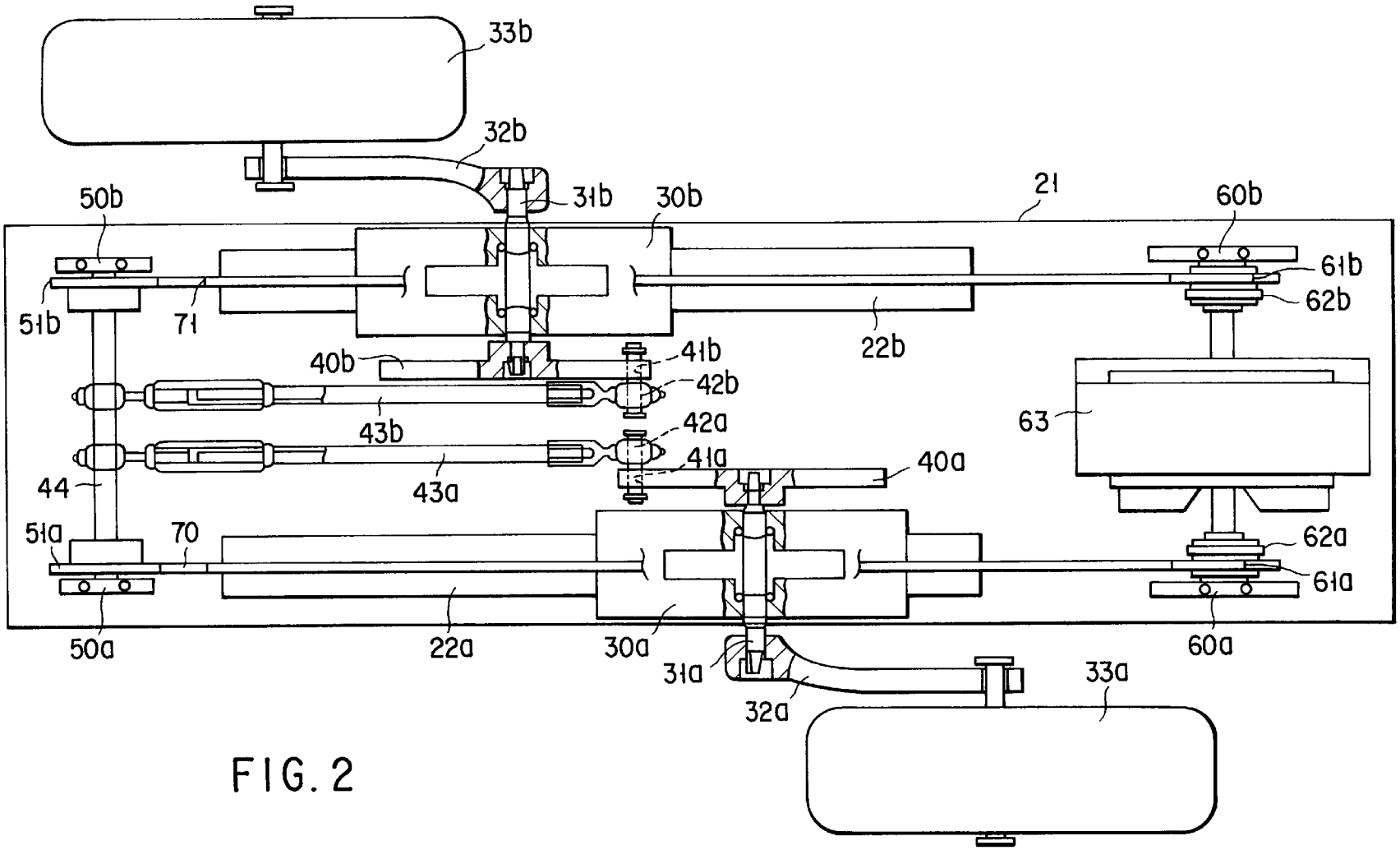
FIG. 2 is a partial cutaway plan view illustrating essential parts of a machinery section incorporated in the bicycle ergometer.
Figure 3:
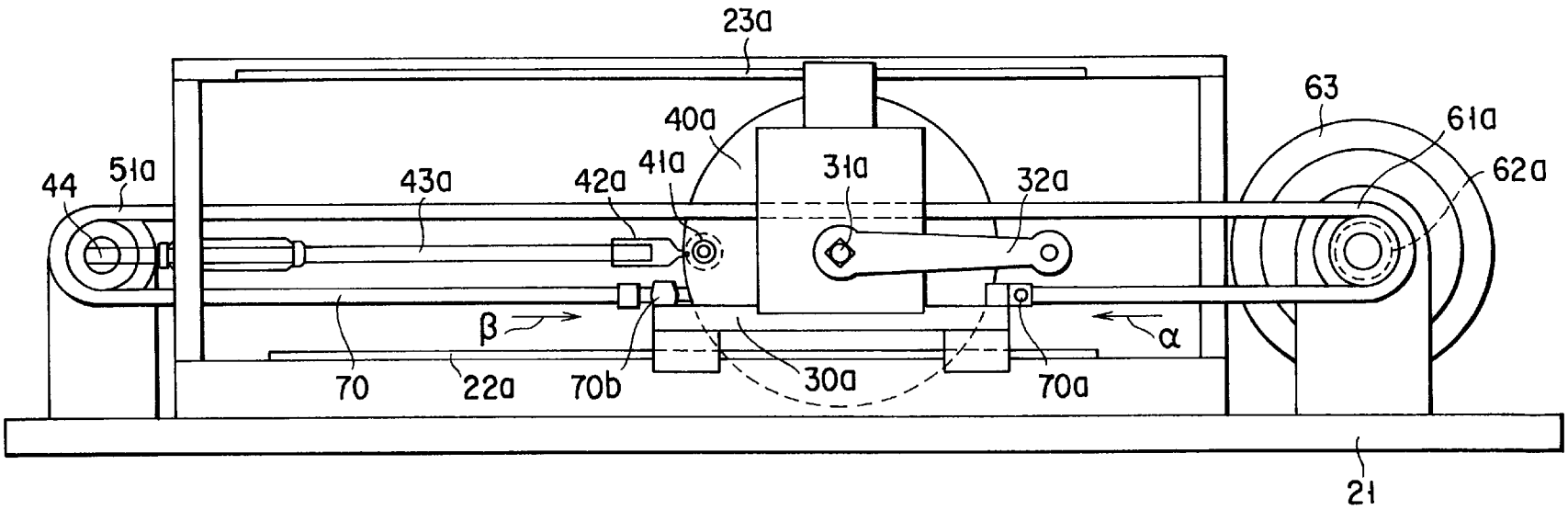
FIG. 3 is a side view illustrating essential parts of the machinery section.
Figure 4A:
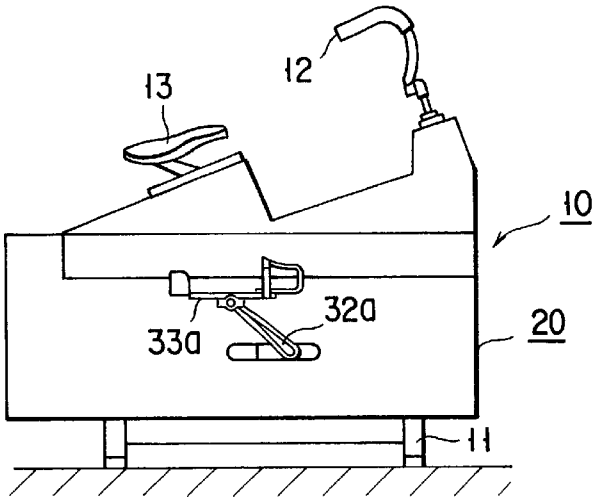
FIGS. 4A–4D are schematic views useful in explaining the operation of the bicycle ergometer.
Figure 4B:
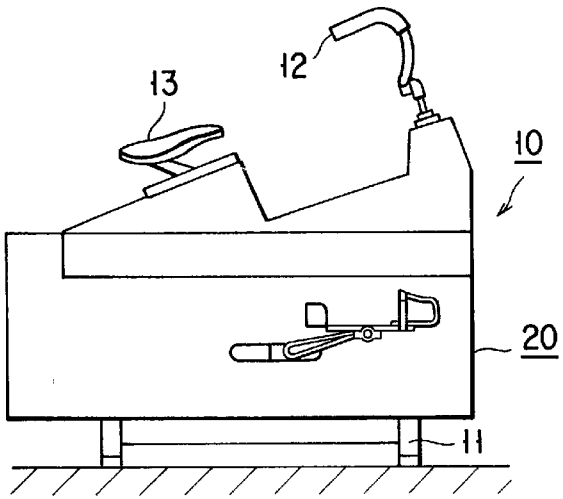
Figure 4C:
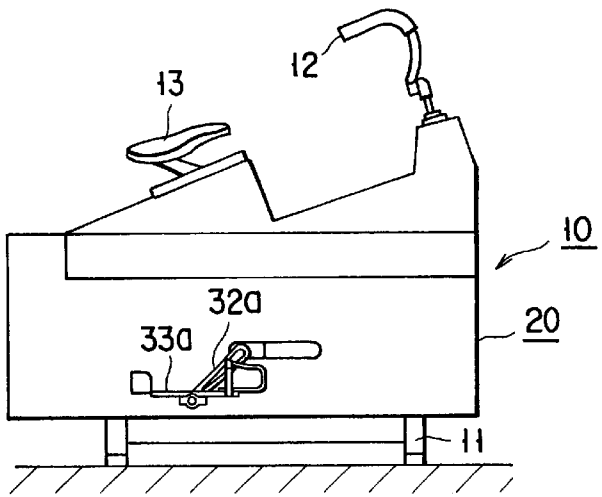
Figure 4D:
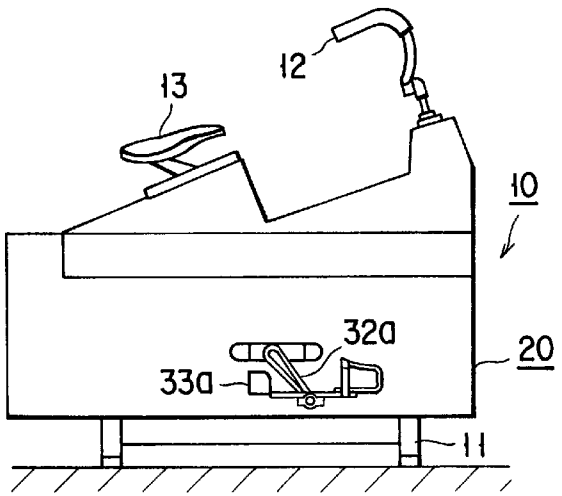

FIG. 1A is a side view illustrating a positionable-axle bicycle ergometer 10 according to the embodiment of the invention. FIG. 1B is a front view of the bicycle ergometer 10. FIG. 2 is a partial cutaway plan view illustrating essential parts of a machinery section 20 incorporated in the bicycle ergometer 10. FIG. 3 is a side view illustrating essential parts of the bicycle ergometer 20.

The positionable-axle bicycle ergometer 10 comprises a base 11 placed on a floor, a bicycle-type handlebar 12, a saddle 13 and the machinery section 20.

As shown in FIGS. 2 and 3, the machinery section 20 has a support section 21 fixed to the base 11. The support section 21 is provided with a pair of lower rails 22*a* and 22*b* and a pair of upper rails 23*a* and 23*b*, which extend in the longitudinal direction of the bicycle ergometer 10. Positionable seats 30*a* and 30*b* are supported by the lower and upper rails 22*a* and 23*a*, and 22*b* and 23*b*, respectively, such that they can reciprocate in directions indicated by arrows α and β in FIG. 3.

Pedal arm axles 31*a* and 31*b* are rotatably supported by the positionable seats 30*a* and 30*b*, respectively, and have their external ends connected to pedal arms 32*a* and 32*b*, respectively. The other ends of the pedal arms 32*a* and 32*b* are connected to pedals 33*a* and 33*b* such that the pedals can rotate. The pedals 33*a* and 33*b* may have, for example, straps for securing the feet of the exerciser.

Disks 40*a* and 40*b* are attached to the internal ends of the pedal arm axles 31*a* and 31*b*, respectively. The disks 40*a* and 40*b* have holes 41*a* and 41*b* formed in their peripheral portions, respectively. Swing shafts 42*a* and 42*b* have their ends swingably inserted in the holes 41*a* and 41*b*, respectively. The other ends of the swing shafts 42*a* and 42*b* are swingably inserted in ends of arm shafts 43*a* and 43*b*, respectively. The other ends of the arm shafts 43*a* and 43*b* are swingably supported by a swing shaft 44 that is supported by support tables 50*a* and 50*b* described later. The disks 40*a* and 40*b*, the swing shafts 42*a* and 42*b*, the arm shafts 43*a* and 43*b* and the swing shaft 44 constitute a positioning mechanism for positioning the positionable seats 30*a* and 30*b*.

The aforementioned pair of support tables 50*a* and 50*b* and a pair of support tables 60*a* and 60*b* are provided on the support section 21. The support tables 50*a* and 50*b* respectively support sprockets 51*a* and 51*b* such that the sprockets can rotate. The swing shaft 44 is supported by the support tables 50*a* and 50*b*.

The support tables 60*a* and 60*b* respectively support sprockets 61*a* and 61*b* such that the sprockets can rotate. An electromagnetic brake 63 is connected to the sprockets 61*a* and 61*b* via respective one-way clutches 62*a* and 62*b*. The load applied by the electromagnetic brake 63 is variable.

Chains 70 and 71 are tensioned between the sprockets 51*a* and 61*a* and between the sprockets 51*b* and 61*b*, respectively. The opposite ends 70*a* and 70*b* of the chain 70 are fixed to the front and rear end portions of the positionable seat 30*a*, respectively. Similarly, the respective opposite ends of the chain 71 are fixed to the front and rear end portions of the positionable seat 30*b*.

Figure 5:
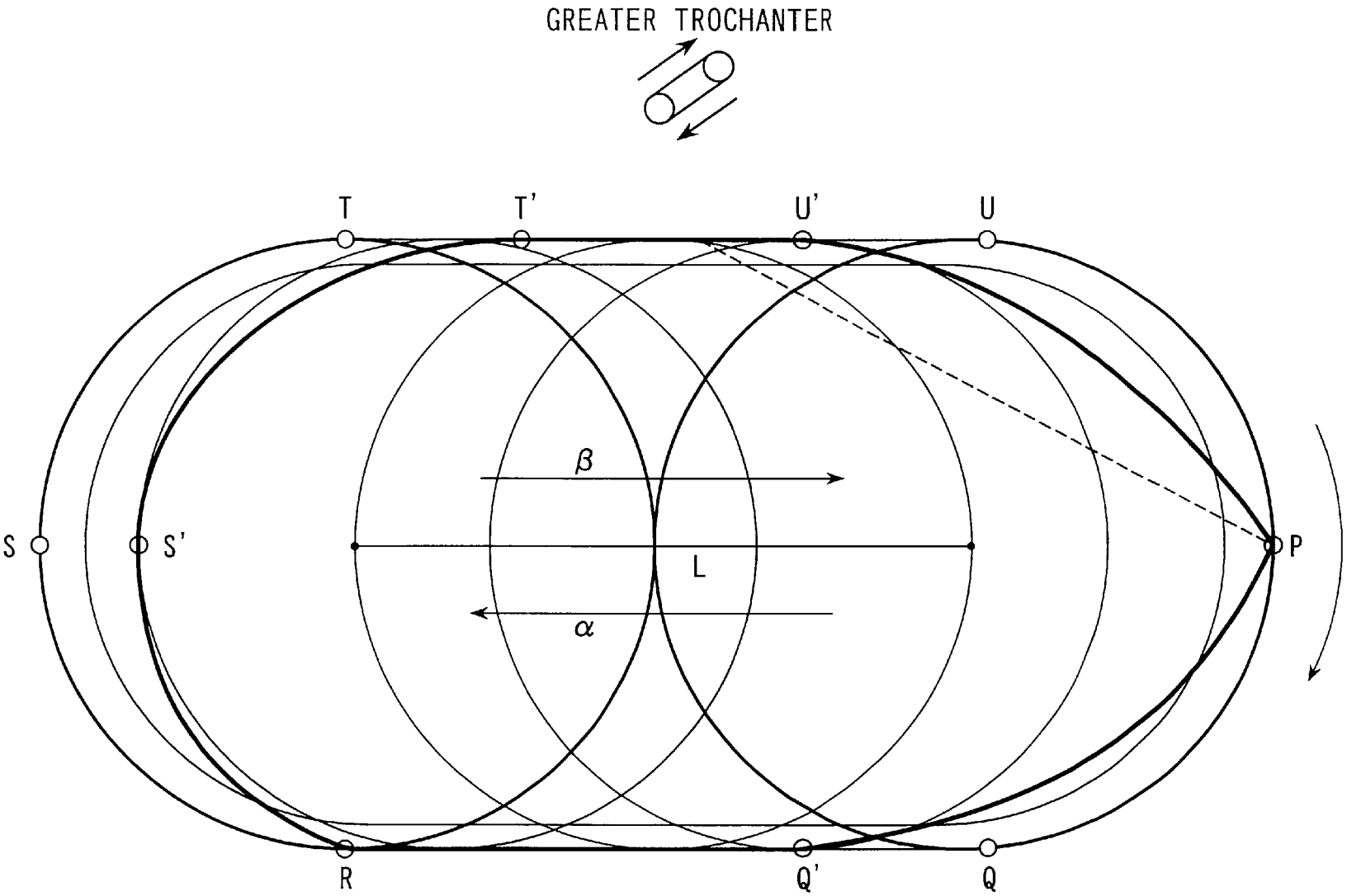
FIG. 5 is a view illustrating the trajectory of a leg indicative of a running motion simulated by the bicycle ergometer.

A description will now be given of a training method using the above-described positionable-axle bicycle ergometer 10. FIGS. 4A–4D are schematic views useful in explaining the operation of the bicycle ergometer 10. FIG. 5 is a view illustrating the trajectory of a leg indicative of a running motion simulated by the bicycle ergometer 10. In FIG. 5, the solid lines indicate the actual trajectory including the shift of the greater trochanter, while the broken line indicates a relative trajectory using the greater trochanter as a reference point.

Using the positional axle bicycle ergometer 10, the exerciser sits on the saddle 13 as in the case of a standard stationary bicycle, and secures their feet on the pedals 33*a* and 33*b*, and grips the handlebar 12. The handlebar 12 is adjustable in height and angle, according to the demands of the user and the type of exercise.

The exerciser stands up from the saddle 13 with their feet on the pedals 33*a* and 33*b*, and starts to step on the pedals 33*a* and 33*b* as in a standard bicycle ergometer. Since the left and right pedals 33*a* and 33*b* operate in the same manner with their positions deviated from each other by 180°, a description will be given of only the right-hand pedal 33*a*.

The exerciser rotates the pedal 33*a* from its front position to its rear position through its lowest position. These positions correspond to the zone AB (the swing-down stage), the zone BC (the ground-contact stage) and the zone CD (the kick-up stage) shown in FIG. 6.

In accordance with the pedaling operation, the disk 40*a* rotates, and the positionable seat 30*a* is shifted rearward by the arm shaft 43*a*. As a result, the chain 70 is pulled in the direction α in FIG. 3, whereby the sprockets 51*a* and 61*a* rotate, and the one-way clutch 62*a* rotates the electromagnetic brake 63. At this time, a predetermined load is applied to the electromagnetic brake 63, thereby executing a braking operation. Accordingly, the exerciser must strongly step on the pedal 33*a*, i.e. must apply their weight onto the pedal. Thus, the exerciser continuously pushes the pedal 33*a* rearward with their strong muscle force. From this operation, the exerciser obtains a feeling similar to that obtained when they have swung down their leg on the ground situated below the center-of-gravity of their body, and used their muscles to counter a reaction from the ground. Further, the exerciser uses their muscles as if they were executing a kick-up operation in a running motion. In other words, the strong pedaling operation is extremely similar to the motion of strongly pushing down on the ground. If the right foot of the exerciser is secured to the pedal 33*a*, they can also use their muscles in accordance with the upward motion of the pedal 33*a*.

Thereafter, the exerciser rotates the pedal 33*a* from its rear position to its front position through its highest position. These positions correspond to the zone DE (the late kick-up stage) and the zone EA (the swing-back stage) shown in FIG. 6. In accordance with the pedaling operation, the disk 40*a* rotates, and the positionable seat 30*a* is shifted frontward by the arm shaft 43*a*. As a result, the chain 70 is pulled in the direction β in FIG. 3, thereby rotating the sprockets 51*a* and 61*a*. At this time, however, no rotational force is transmitted to the electromagnetic brake 63 because of the one-way clutch 62*a*. Accordingly, no resistance load is applied to the pedal 33*a*.

Figure 6:
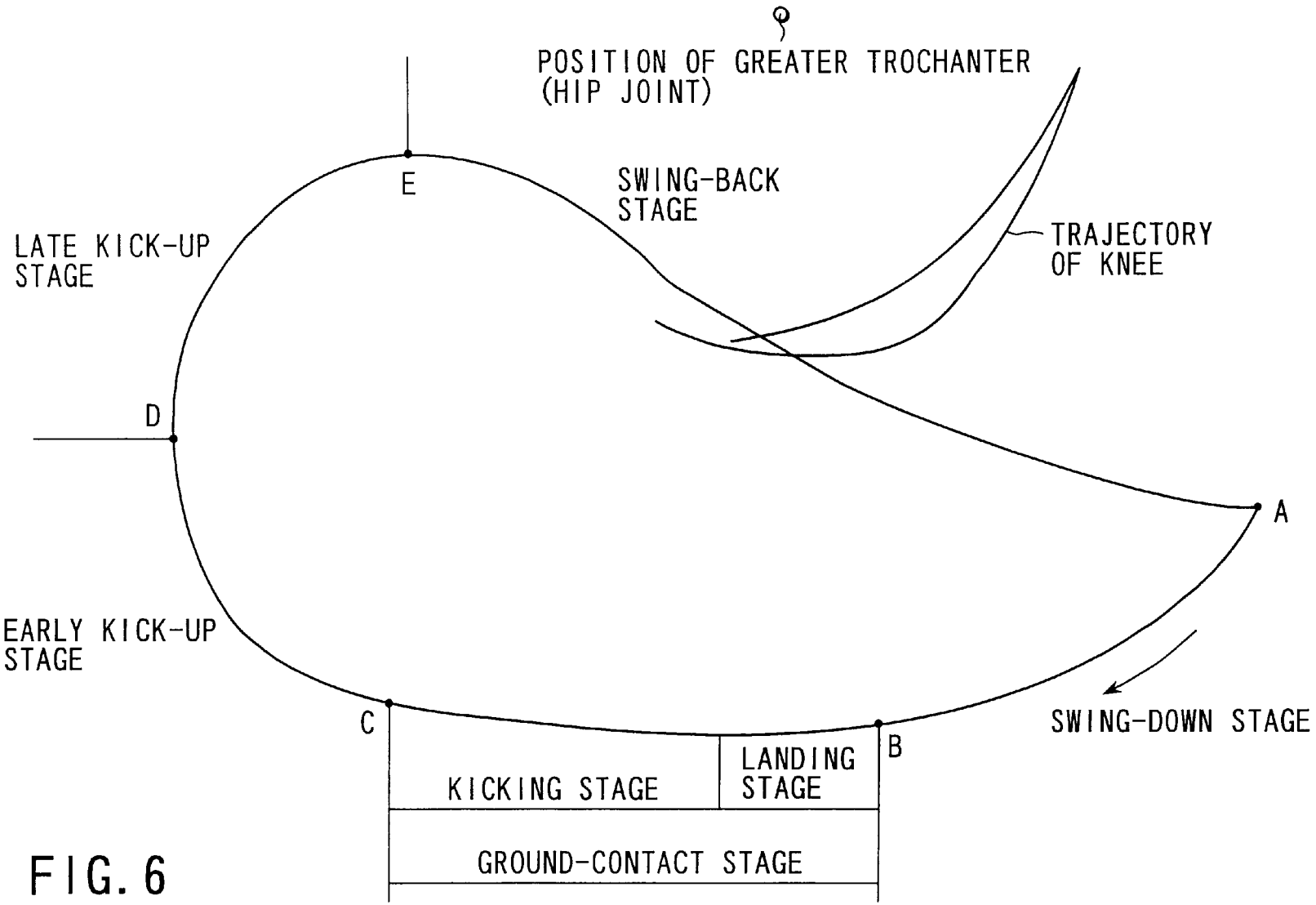
FIG. 6 is a view illustrating the trajectory of a leg indicative of an ideal running motion.

In the ideal running motion shown in FIG. 6, it is considered good to land the leg just below the center-of-gravity of the body, and to kick the ground so as to push it. The motion of strongly stepping on each pedal of the positionable-axle bicycle ergometer 10, with the weight of the body applied to a corresponding knee, enables the exerciser to have a feeling similar to that obtained when they land each leg just below the center-of-gravity of the body and receive a reaction from the ground. Further, the strong pedaling motion is extremely similar to the motion of strongly pushing down on the ground.

FIG. 5 illustrates the trajectory of a leg moved using the positionable-axle bicycle ergometer 10. In FIG. 5, zones PQ', Q'R, RS', S'T' and T'U'P correspond to the swing-down stage, the ground-contact stage, the early kick-up stage, the late kick-up stage and the swing-back stage, respectively. In a zone PQ'R, the quadricepses are mainly trained, while in the zone RS', the hamstrings are mainly trained.

The circular trajectory of the leg, as a result of the actual motion executed using the positionable-axle bicycle ergometer 10, is obtained by those rotations of the leg about the pedal arm axles 31*a* and 31*b*, which are executed while these axles horizontally move forward and backward. In the shown model case, it appears that the trajectory of the pedaling motion slightly differs from that of the actual motion of running. Further, the position of the hip joint is fixed. However, in the actual swing-back stage of the pedaling motion executed using the ergometer 10, the hip joint is slightly raised obliquely forward, thereby raising each knee joint. As a result, the pedaling motion is an approximation of the motion of actual running.

Although the balls of the feet are kept in contact with the pedals 33*a* and 33*b*, the ankle of each foot is movable about a joint of each foot as in the case of pedaling a normal bicycle. Therefore, irrespective of the fact that the trajectory of each ankle is actually circular, the motion of the feet alternately stepping down on, and kicking up from each pedal corresponds respectively to the landing motion beginning at the heel, and the kicking-up motion of the ball or toes, of running, and is smoothly executed.

The obliquely forward raise of the hip joint in a zone TUP (the swing-back stage) is executed by a flexible motion of the pelvis, and is a fundamental element for forming an ideal form in a sprint motion, as well as the raise of each knee. Further, the obliquely forward raise of the hip joint is very effective when learning about the use of muscles in the zone PQRS, the relaxation of the muscles in the zone STUP in which no load is applied, and the interrelationship of muscles and the nervous system.

The moving distance L and the moving speed in the zones QR and TU can be altered by changing the length of the arm shafts 43*a* and 43*b* or the positions in which the arm shafts 43*a* and 43*b* are connected to the disks 40*a* and 40*b*, respectively. These alterations enable the ergometer to meet the demands of a variety of exercise types and body types related to the sport concerned. In the zone TUP (the swing-back stage), the exerciser has to adjust the timing of a stepping motion in a position P in which the next cycle starts, in accordance with the moving speed in the zone TU.

As described above, the positionable-axle bicycle ergometer 10 according to the embodiment enables the exerciser to train their muscles simply by moving their legs along a mechanically-determined ideal running trajectory. Thus, the exerciser can learn an ideal running motion through the interrelationship of their muscles and nervous system. Moreover, the ergometer of the invention enables the exerciser to determine how much force they have to apply with their muscles, to counter the differing load encountered at various pedal positions. In other words, the ergometer of the invention brings out a muscle training effect which enhances the running or walking ability of muscles of the body, including the leg muscles.

Furthermore, the ergometer of the invention enables the exerciser to execute training with any arbitrary pedal-arm-rotation rhythm based on a simulated ideal running motion. Thus, ideal muscle-training is realized.

In addition, the basic motion of a conventional fixed-axle bicycle ergometer is only of pedaling, by which muscles directly related to running or walking cannot be trained. On the other hand, the positionable-axle bicycle ergometer 10 can train muscles directly related to running or walking. Therefore, it can be used not only to enhance the ability of running or walking, but also as a rehabilitation exercise. When, for example, an athlete who cannot run because of a handicap tries to increase their body stamina, using a pedaling motion, the positionable-axle bicycle ergometer, free from the landing shock associated with normal running, is very useful as an exercise machine.

Furthermore, since the positionable-axle bicycle ergometer of the invention uses the pedaling force of the exerciser to reciprocate the axle of each pedal, no particular power source is necessary and hence the ergometer can have a simple structure.

The invention is not limited to the above-described embodiment, but may be modified in various ways without departing from its scope.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A positionable-axle bicycle ergometer comprising:

a pair of axles each to be supplied with a rotational force from a corresponding one of a pair of pedals and a corresponding one of a pair of arms;

a pair of seats each supporting a corresponding one of the pair of axles;

a pair of guide sections each supporting a corresponding one of the pair of seats such that the pair of seats can reciprocate in a direction perpendicular to the pair of axles, a pair of positioning mechanisms each for positioning a corresponding one of the pair of seats by a corresponding one of the pair of guide sections in accordance with a rotation angle of the axles; and braking mechanisms each braking a corresponding one of the pair of axles, wherein the positioning mechanisms each include a rotary wheel using a corresponding one of the axles as an axis of rotation, and an arm having a proximal end swingably supported by a table and a distal end swingably and eccentrically supported by the rotary wheel.

2. The positionable-axle bicycle ergometer according to claim 1, wherein the braking mechanisms each includes a belt capable of a reciprocating motion in accordance with a reciprocating motion of a corresponding one of the seats, and a load mechanism for braking the belt.

3. The positionable-axle bicycle ergometer according to claim 1, wherein the braking mechanisms are controlled to apply a resistance load to the pedals when the pedals are positioned at a level lower than the axles, and to apply no load to the pedals when the pedals are positioned at a level higher than the axles.

* * * * *